US007651198B2

(12) United States Patent
Yokouchi

(10) Patent No.: US 7,651,198 B2
(45) Date of Patent: Jan. 26, 2010

(54) LIQUID DROPLET EJECTION HEAD AND IMAGE FORMING APPARATUS

(75) Inventor: Tsutomu Yokouchi, Kanagawa (JP)
(73) Assignee: Fujifilm Corporation, Tokyo (JP)

( * ) Notice: Subject to any disclaimer, the term of this patent is extended or adjusted under 35 U.S.C. 154(b) by 492 days.
(21) Appl. No.: 11/230,580
(22) Filed: Sep. 21, 2005
(65) Prior Publication Data
US 2006/0061631 A1 Mar. 23, 2006
(30) Foreign Application Priority Data
Sep. 22, 2004 (JP) ..... 2004-275854
(51) Int. Cl.
*B41J 2/045* (2006.01)
(52) U.S. Cl. ..... 347/68
(58) Field of Classification Search ..... 347/57–59, 347/70–71
See application file for complete search history.

(56) References Cited

U.S. PATENT DOCUMENTS

| | | | | |
|---|---|---|---|---|
| 5,940,099 | A | 8/1999 | Karlinski | |
| 6,186,618 | B1 * | 2/2001 | Usui et al. | 347/70 |
| 6,439,702 | B1 | 8/2002 | Karlinski | |
| 6,481,074 | B1 | 11/2002 | Karlinski | |
| 6,616,270 | B1 | 9/2003 | Miyata et al. | |
| 6,766,567 | B2 | 7/2004 | Karlinski | |

(Continued)

FOREIGN PATENT DOCUMENTS

JP 9-226114 A 9/1997

(Continued)

OTHER PUBLICATIONS

Callister, William D. Jr., Materials Science and Engineering: An introduction (NewYork John Wiley & Sons, 1996), pp. 777-778 TA403.C23.*

(Continued)

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The liquid droplet ejection head comprises: a plurality of pressure chambers which are separated by a partition wall, each of the plurality of pressure chambers being formed with a first member and a second member in opposition to the first member, each of the plurality of pressure chambers having a nozzle and a supply port, the nozzle being formed in the first member for ejecting a droplet of a liquid onto a recording medium, the supply port being formed in the second member for supplying the liquid to the pressure chamber; a piezoelectric element which causes the pressure chamber to deform, the piezoelectric element having an electrode for the piezoelectric element, the piezoelectric element being provided on a side of the second member opposite to an inside of the pressure chamber; a common liquid chamber which supplies the liquid to the pressure chamber through the supply port, the common liquid chamber being provided on the side of the second member on which the piezoelectric element is provided; and a wiring member which is formed in the common liquid chamber so as to stand upright from the electrode for the piezoelectric element in a direction substantially perpendicular to the second member, and is disposed in a position corresponding to the partition wall.

8 Claims, 12 Drawing Sheets

U.S. PATENT DOCUMENTS

| | | | | |
|---|---|---|---|---|
| 2003/0030705 | A1 * | 2/2003 | Koike et al. | 347/69 |
| 2003/0088969 | A1 | 5/2003 | Karlinski | |
| 2003/0206218 | A1 | 11/2003 | Miyata et al. | |

FOREIGN PATENT DOCUMENTS

| | | | | |
|---|---|---|---|---|
| JP | 09226114 | A | * | 9/1997 |
| JP | 2000-127379 | A | | 5/2000 |
| JP | 2000-289201 | A | | 10/2000 |
| JP | 2001-179973 | A | | 7/2001 |
| WO | WO-01/30577 | A1 | | 5/2001 |

OTHER PUBLICATIONS

Callister, William D., Jr. Materials Science and Engineering: An introduction (New York, John Wiley & Sons, 1996), pp. 777-778 TA403.C23.*

* cited by examiner

LIQUID DROPLET EJECTION HEAD AND IMAGE FORMING APPARATUS

BACKGROUND OF THE INVENTION

1. Field of the Invention

The present invention relates to a liquid droplet ejection head and an image forming apparatus, and more particularly to a technique for arranging wiring for driving a piezoelectric element provided in the liquid droplet ejection head.

2. Description of the Related Art

An inkjet-type image forming apparatus comprises a print head having a large number of nozzles arranged in a matrix form. An image is formed on a recording medium by depositing ink droplets onto the recording medium from the nozzles.

In a print head according to a related art shown in FIG. 18, ink is supplied to a pressure chamber 52 from a common liquid chamber 55 disposed on the same side as the pressure chamber 52, and a diaphragm 56 which forms a ceiling surface of the pressure chamber 52 is the boundaries of the pressure chamber. When an electric signal corresponding to image data is transmitted to a piezoelectric element 58 disposed above the diaphragm 56, the piezoelectric element 58 is driven to deform the diaphragm 56. As a result, the volume of the pressure chamber 52 decreases, causing an ink droplet to be ejected from a nozzle 51. The ink droplet lands on the recording medium, and thus forms a dot on the recording medium. By combining such dots, a single image is formed on the recording medium.

In recent years, demands have been made for improvements in the image quality by image forming apparatuses. To achieve high image quality, the nozzles must be arranged in the print head at a high density to increase the number of pixels per image. Various techniques for increasing the nozzle density have been proposed in the related art (see, for example, Japanese Patent Application Publication Nos. 9-226114, 2001-179973, 2000-127379, 2000-289201, 2003-512211, and so on).

Japanese Patent Application Publication No. 9-226114 discloses a print head in which a piezoelectric element is disposed on a diaphragm constituting the ceiling surface of a pressure chamber, a reservoir (common liquid chamber) is provided on the piezoelectric element side of the diaphragm, and an ink supply hole is provided in the diaphragm.

Japanese Patent Application Publication No. 2001-179973 discloses a print head in which a piezoelectric body (piezoelectric element) is disposed on a diaphragm constituting the ceiling surface of a pressure chamber, and an ink supply tank (common liquid chamber) is provided above the piezoelectric body across a partition wall.

Japanese Patent Application Publication No. 2000-127379 discloses a print head in which a reservoir (common liquid chamber) is formed on the same side as a piezoelectric element that is disposed on an opposite surface side to the nozzle side of a pressure generating chamber (pressure chamber).

Japanese Patent Application Publication No. 2000-289201 discloses a print head in which a piezoelectric actuator (piezoelectric element) and a common ink chamber (common liquid chamber) are disposed on the same surface side as a nozzle side of a pressure chamber, and a substrate (wiring layer) is disposed on the opposite surface side to the nozzle side of the pressure chamber.

Japanese Patent Application Publication No. 2003-512211 discloses a print head in which an ink supply layer made from porous member for supplying ink to a pressure chamber is disposed between a nozzle layer in which nozzles are formed and a cavity layer constituting an ink cavity (pressure chamber). A piezoelectric element is disposed on a displacement plate (diaphragm) which forms the ceiling plate of the ink cavity, and a conductive connecting element (wiring member) is provided from the piezoelectric element in a direction substantially perpendicular to the diaphragm. A substrate (wiring layer) is beyond the conductive connecting member.

In the print head according to the related art shown in FIG. 18, the flow passage connecting the common liquid chamber and pressure chamber has a complicated constitution. Therefore, when highly viscous ink is used, a problem arises in that the refilling performance to supply ink to the pressure chamber following ink ejection is not good.

When the wiring for driving the piezoelectric element is arranged on the diaphragm, as in the case of the print heads disclosed in Japanese Patent Application Publication Nos. 9-226114 and 2001-179973, it is difficult to secure sufficient space for the drive wiring and to dispose the nozzles at a high density.

In the print head disclosed in Japanese Patent Application Publication No. 2000-127379, the drive wiring for the piezoelectric element is formed by wire bonding or film deposition, and connected to external wiring mounted above the common liquid chamber. However, since the drive wiring is provided on the exterior of the common liquid chamber, it is difficult to secure sufficient space for the piezoelectric element drive wiring, and restrictions are also placed on the size of the common liquid chamber. When the size of the common liquid chamber is reduced, the ink supply to each pressure chamber tends to be insufficient, and hence it becomes difficult to drive each nozzle at high frequency. Moreover, Japanese Patent Application Publication No. 2000-127379 only deals with the constitution of a print head having a single nozzle array, and hence this print head is not suitable for a constitution in which a large number of nozzles are disposed at high density.

In Japanese Patent Application Publication No. 2000-289201, drive wiring (an aluminum plug) connecting the piezoelectric element and wiring layer is formed to pass through a laminated plate between the piezoelectric element and wiring layer, which are disposed on either side of the pressure chamber. As a result, it is difficult to secure enough space for the drive wiring and dispose the nozzles at high density.

In the print head disclosed in Japanese Patent Application Publication No. 2003-512211, a common liquid chamber (ink manifold) storing ink to be supplied to the ink supply layer is provided on the opposite side of the wiring layer to a wiring member side, causing a flow passage that connects the common liquid chamber and pressure chamber via the ink supply layer to increase in length. Hence, if the density of the nozzles is increased, there may not be enough time to supply ink from the common liquid chamber to the pressure chamber. In particular, when highly viscous ink is used, the ink supply layer is constituted by a porous member, and therefore ink supply may be delayed even further.

In response to these problems, a patent application which was, at the time the present invention was made, not published, not publicly known, and assigned to the same assignee to which the present invention was subject to an obligation of assignment, proposes a print head in which the common liquid chamber is provided on the opposite side of the diaphragm to the pressure chamber, and a wiring member including wiring for driving the piezoelectric element is provided so as to pass through the common liquid chamber.

It is desirable to improve this print head to prevent deformation of the diaphragm under the load that is applied when the wiring member and piezoelectric element are connected.

In other words, if the piezoelectric element or diaphragm deforms under the load that is applied at the time of connection, it may become difficult to obtain the desired ejection performance. Moreover, if an even larger load is applied, the piezoelectric element may break.

In the print head disclosed in Japanese Patent Application Publication No. 2003-512211, the wiring for driving the piezoelectric element, which is provided in a direction substantially perpendicular to the diaphragm, is constituted by an elastic member in order to prevent deformation of the piezoelectric element. However, the disposal of the wiring member is not taken into account, and therefore the piezoelectric element or diaphragm may deform under the load applied during connection.

Furthermore, following completion of the print head, stress generated during incorporation into a housing or the like is applied, via the wiring member, to the piezoelectric element and the diaphragm. Hence, the piezoelectric element and diaphragm may deform as in the case of the time of connection. Even when a manufacturing method which does not require joining based on applying load to the wiring member, such as a manufacturing method using a photo-process, is employed, if the wiring member exists directly above the pressure chamber cavity, the stress on the print head generated during incorporation into a housing is applied to the piezoelectric element and diaphragm via the wiring member, and hence the problems described above may still occur.

SUMMARY OF THE INVENTION

The present invention has been contrived in consideration of these circumstances, and it is an object thereof to provide a liquid droplet ejection head and an image forming apparatus which prevents deformation of a diaphragm so that a desired ejection performance can be obtained when a wiring member, including drive wiring for driving a piezoelectric element, is arranged in a direction substantially perpendicular to the diaphragm so as to pass through a common liquid chamber disposed on the opposite side of the diaphragm to a pressure chamber.

In order to attain the aforementioned object, the present invention is directed to a liquid droplet ejection head, comprising: a plurality of pressure chambers which are separated by a partition wall, each of the plurality of pressure chambers being formed with a first member and a second member in opposition to the first member, each of the plurality of pressure chambers having a nozzle and a supply port, the nozzle being formed in the first member for ejecting a droplet of a liquid onto a recording medium, the supply port being formed in the second member for supplying the liquid to the pressure chamber; a piezoelectric element which causes the pressure chamber to deform, the piezoelectric element having an electrode for the piezoelectric element, the piezoelectric element being provided on a side of the second member opposite to an inside of the pressure chamber; a common liquid chamber which supplies the liquid to the pressure chamber through the supply port, the common liquid chamber being provided on the side of the second member on which the piezoelectric element is provided; and a wiring member which is formed in the common liquid chamber so as to stand upright from the electrode for the piezoelectric element in a direction substantially perpendicular to the second member, and is disposed in a position corresponding to the partition wall.

According to the present invention, the wiring member is disposed to be supported by partition wall part separating the pressure chambers, via the diaphragm. Hence, deformation of the diaphragm under the load applied through the wiring member can be prevented. As a result, deformation of the piezoelectric element can be prevented, and a desired ejection performance can be obtained.

Preferably, the wiring member is disposed so that a center of a surface of the wiring member on the side of the second member is overlapped with a surface of the partition wall contacting the second member.

More preferably, the wiring member is disposed so that an entire surface of the wiring member on the side of the second member side is overlapped with a surface of the partition wall contacting the second member.

Further preferably, the wiring member is disposed so that a center of a surface of the wiring member on the side of the second member is overlapped with a projected surface of a thinnest portion of the partition wall, the projected surface being obtained by projecting the thinnest portion onto the second member.

Furthermore preferably, the wiring member is disposed so that an entire surface of the wiring member on the side of the second member is overlapped with a projected surface of a thinnest portion of the partition wall, the projected surface being obtained by projecting the thinnest portion onto the second member. According to this, the thinnest portion of the partition wall is used as a reference, and the entire surface of the wiring member on the second member side is overlapped with the projected surface of the thinnest portion projected onto the second member. Hence, deformation of the diaphragm can be prevented more reliably than in other aspects of the present invention.

Each of these aspects of the present invention corresponds that the wiring member is disposed in the position corresponding to the partition wall part of the pressure chambers. In each of these aspects, deformation of the diaphragm under the load applied through the wiring member can be prevented.

Preferably, a Young's modulus of the wiring member is equal to or lower than a Young's modulus of the partition wall. According to this, deformation of the pressure chamber can be prevented when the wiring member is connected.

Preferably, the wiring member is disposed away from the supply port by a predetermined distance. The predetermined distance is preferably no less than 20 μm, more preferably no less than 30 μm. According to this, blockage of the supply port due to excess adhesive produced when the wiring member is adhered to the piezoelectric element electrode can be prevented.

In order to attain the aforementioned object, the present invention is also directed to an image forming device comprising the above-described liquid droplet ejection head.

According to the present invention, the wiring member is disposed to be supported by the pressure chamber partition wall part via the diaphragm, and hence deformation of the diaphragm under the load applied through the wiring member can be prevented. As a result, deformation of the piezoelectric element can be prevented, and a desired ejection performance can be obtained.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Overall Constitution of Inkjet Recording Apparatus

Figure 1:
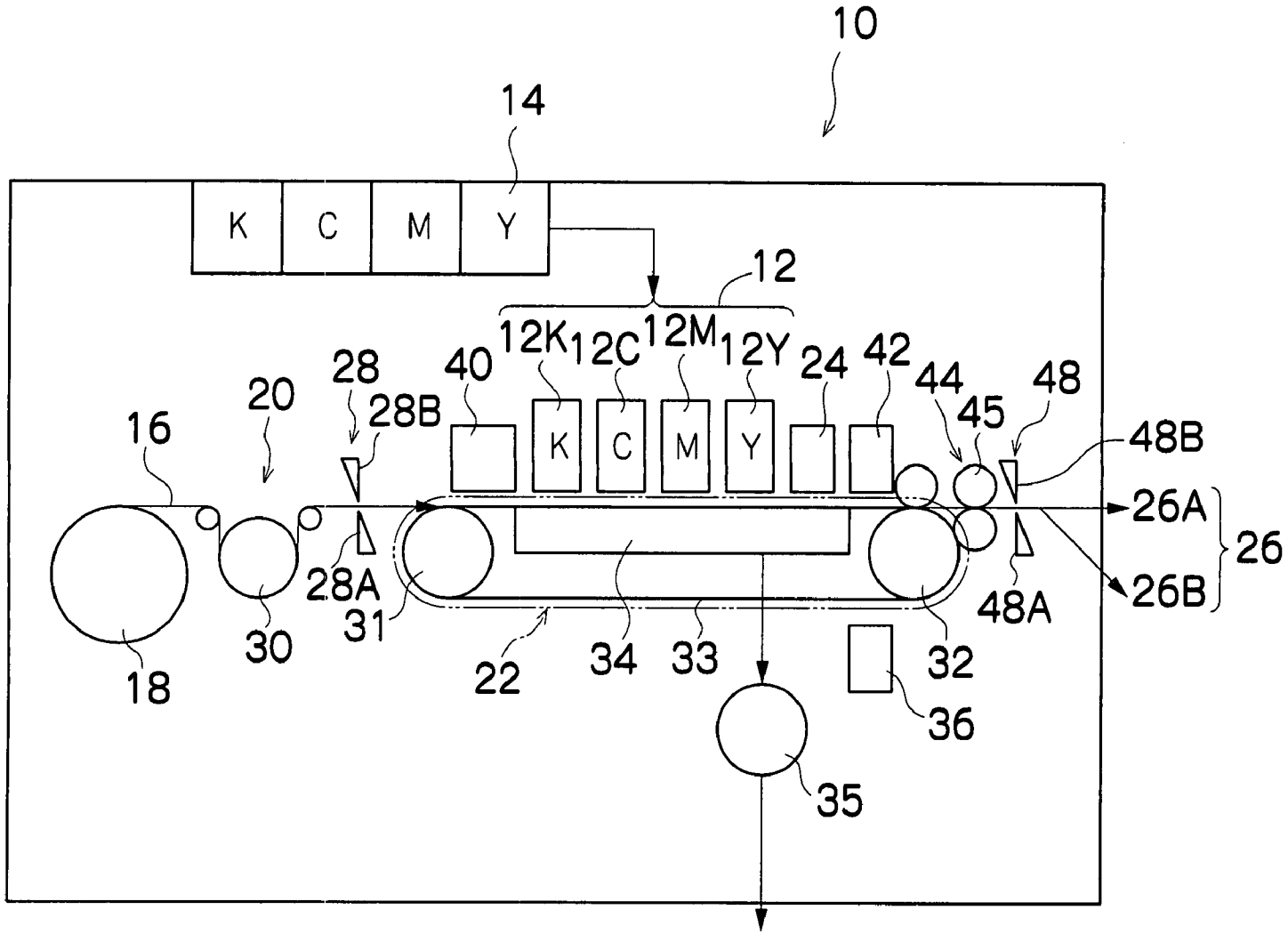
FIG. 1 is a general schematic drawing showing an embodiment of an inkjet recording apparatus which serves as an image forming apparatus according to the present invention.

FIG. 1 is a general compositional diagram showing an approximate view of an inkjet recording apparatus forming an image forming apparatus having a liquid ejection apparatus according to a first embodiment of the present invention. As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area, as shown in the present embodiment, is preferable.

A heating fan 40 is provided on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
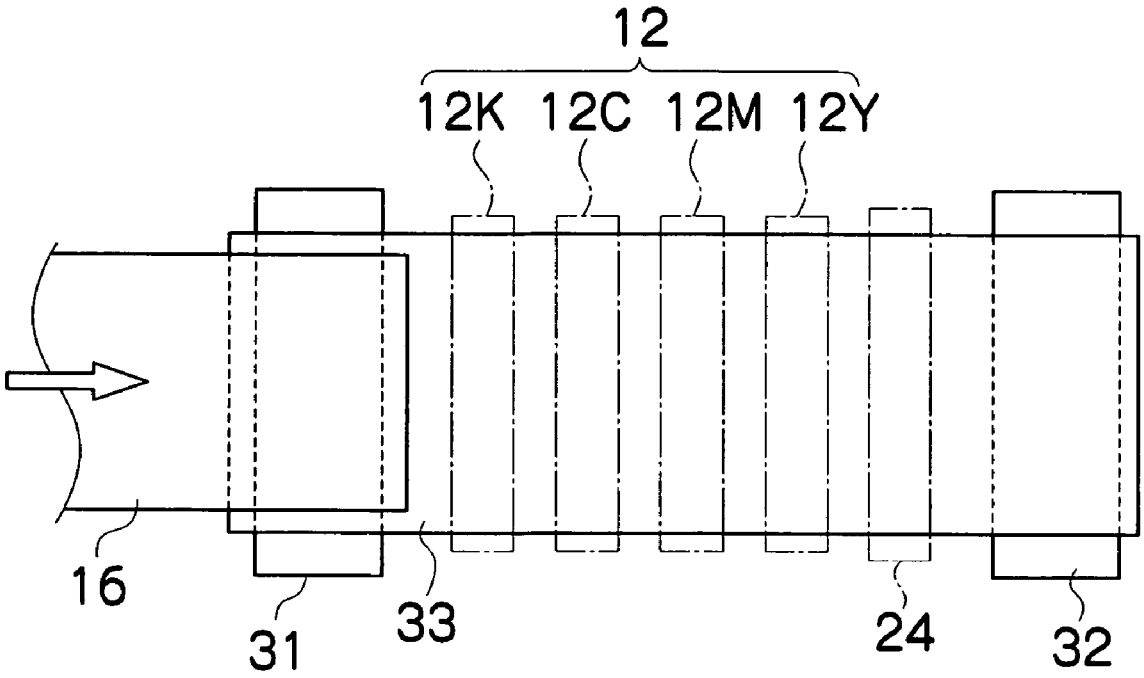
FIG. 2 is a principal plan view of the periphery of a print head of the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y, which form the printing unit 12, are constituted by the line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Although a configuration with the four standard colors, K, C, M, and Y, is described in the present embodiment, the combinations of the ink colors and the number of colors are not limited to these. Light and/or dark inks can be added the configuration as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y. Each tank is connected to a respective print head 12K, 12C, 12M, 12Y, via a tube channel (not shown). Moreover, the ink storing and loading unit 14 also comprises a notifying device (display device, alarm generating device, or the like) for generating a notification if the remaining amount of ink has become low, as well as a mechanism for preventing incorrect loading of the wrong colored ink.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 according to the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of the line sensor, it is possible to use an area sensor composed of photoelectric transducing elements that are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In a case in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface. The image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collecting the images according to job orders is provided in the paper output section 26A corresponding to the main images.

The print heads 12K, 12C, 12M, and 12Y provided for the respective ink colors each have the same structure, and a print head forming a representative example of these print heads is indicated by the reference numeral 50.

Constitution of Ink Supply System

Figure 3:
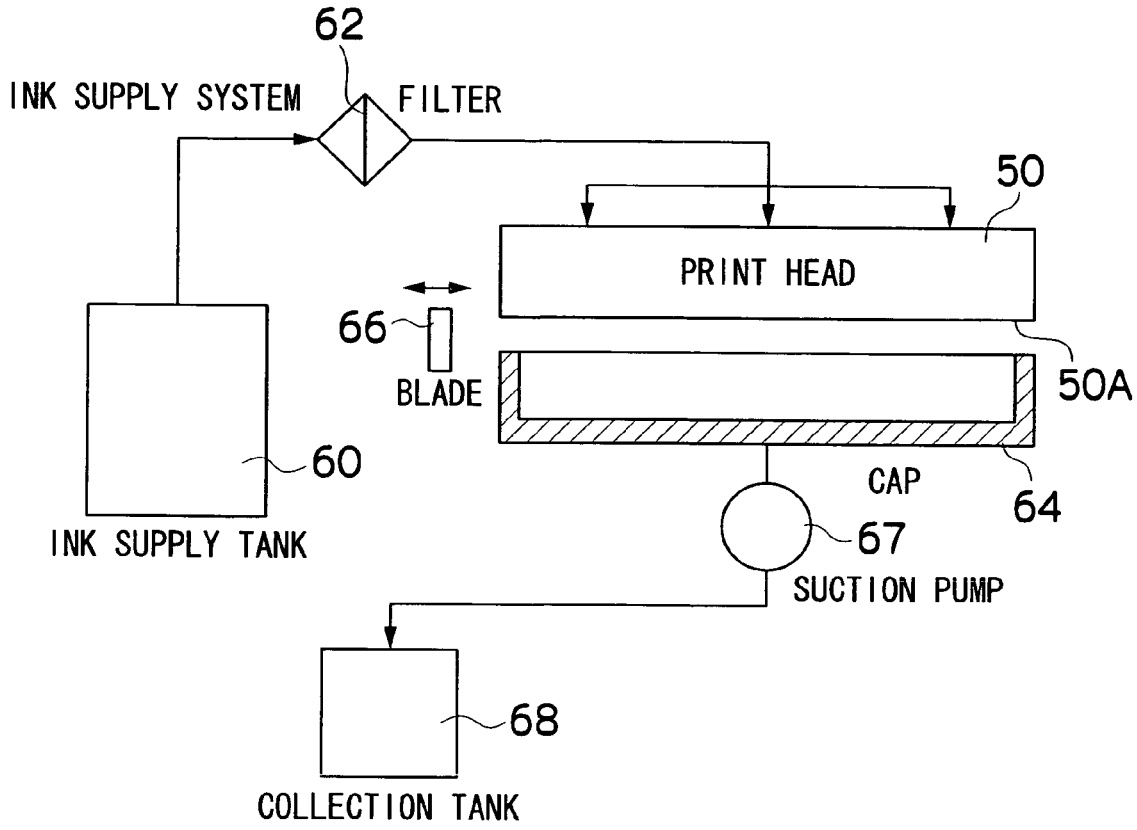
FIG. 3 is a schematic diagram showing the constitution of an ink supply system in the inkjet recording apparatus.

FIG. 3 is a conceptual diagram showing the composition of an ink supply system in the inkjet recording apparatus 10. The ink tank 60 is a base tank for supplying ink to the print head 50, and this ink tank 60 is disposed in the ink storing and loading unit 14 shown in FIG. 1. The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. The ink supply tank 60 in FIG. 3 is equivalent to the ink storing and loading unit 14 in FIG. 1 described above.

As shown in FIG. 3, a filter 62 for eliminating foreign material and air bubbles is provided at an intermediate position of the tubing that connects the ink tank 60 with the print head 50. Desirably, the filter mesh size is the same as the nozzle diameter in the print head 50, or smaller than the nozzle diameter (generally, about 20 μm). Although not shown in FIG. 3, it is preferable to provide a sub-tank integrally to the print head 50 or nearby the print head 50. The sub-tank has a damper function for preventing variation in the internal pressure of the head and a function for improving refilling of the print head.

Furthermore, the inkjet recording apparatus 10 is also provided with a cap 64 forming a device to prevent the nozzles from drying out or to prevent an increase in the ink viscosity in the vicinity of the nozzles, and a cleaning blade 66 forming a device to clean the nozzle surface 50A. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the nozzle surface 50A of the print head 50 by means of a blade movement mechanism (not shown). If there are ink droplets or foreign matter adhering to the nozzle surface 50A, then the nozzle surface 50A is wiped by causing the cleaning blade 66 to slide over the surface of the nozzle plate, thereby cleaning the nozzle surface 50A.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed in the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by the suction is sent to a collecting tank 68. This suction operation is also carried out in order to suction and remove degraded ink which has hardened due to increasing in viscosity when ink is loaded into the print head 50 for the first time, and when the print head starts to be used after having been out of use for a long period of time.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 (not shown in FIG. 3, but shown in FIG. 7) for the ejection driving is operated. Before reaching such a state (in a viscosity range that allows ejection by the operation of the piezoelectric element 58) the piezoelectric element 58 is operated to perform the preliminary discharge to eject the ink of which viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, if air bubbles have become mixed into the ink in the nozzles 51 or the pressure chambers 52, or if the ink viscosity inside the nozzles 51 has risen to a certain level or above, then even if the piezoelectric elements 58 are operated, it will be impossible to eject ink from the nozzles 51. In a case of this kind, a cap 64 is placed on the nozzle surface 50A of the print head 50, and the ink containing air bubbles or the ink of increased viscosity inside the pressure chambers 52 is suctioned by the suction pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor.

Description of Control System

Figure 4:
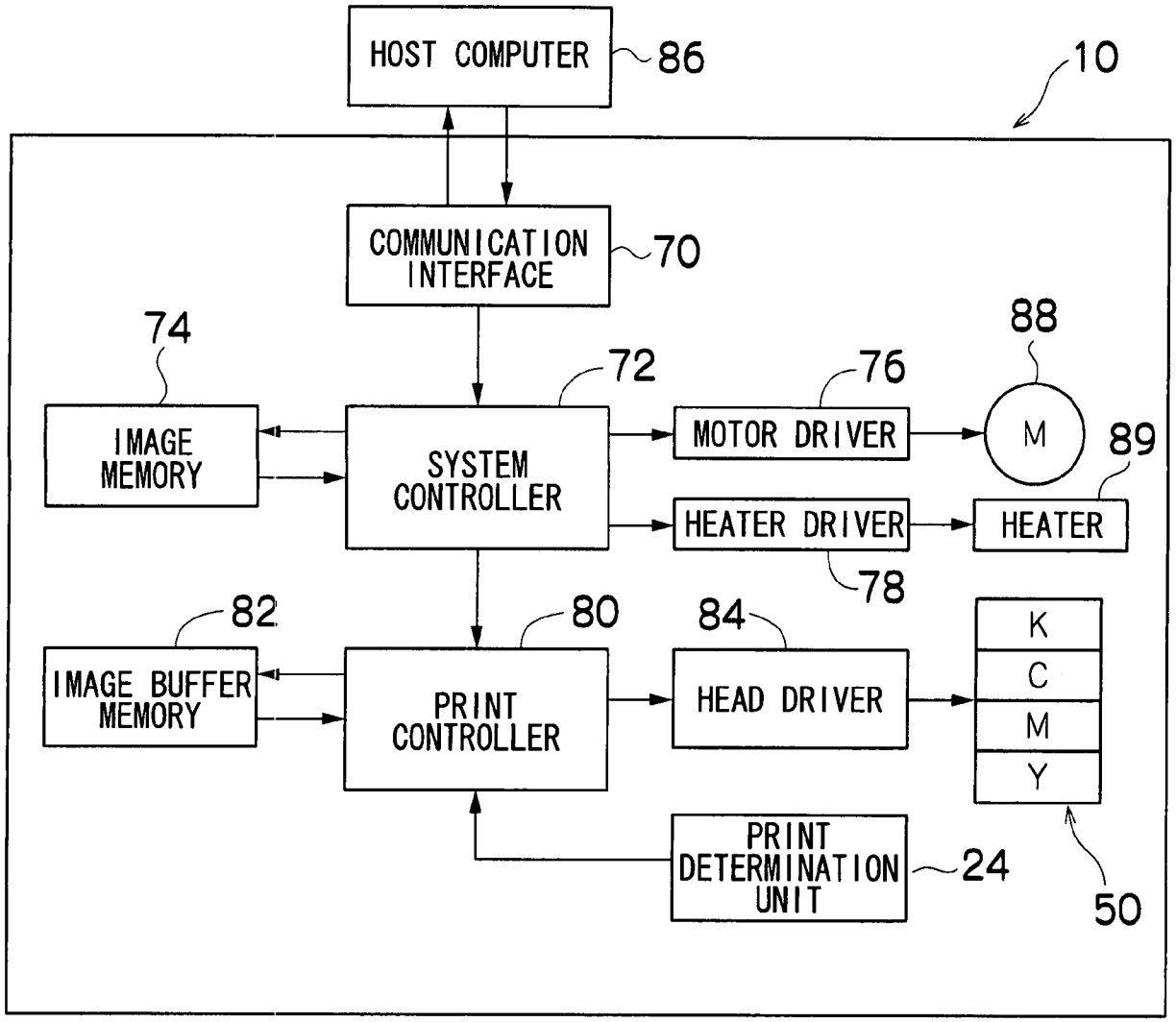
FIG. 4 is a principal block diagram showing the system constitution of the inkjet recording apparatus.

FIG. 4 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 includes a central processing unit (CPU) and peripheral circuits thereof, and the like. In addition to controlling communications with the host computer 86 and controlling reading and writing from and to the image memory 74, or the like, the system controller 72 also generates a control signal for controlling the motor 88 of the conveyance system and the heater 89.

The motor driver 76 is a driver (drive circuit) which drives the motor 88 in accordance with instructions from the system controller 72. The heater driver 78 is a driver that drives the heater 89 in accordance with instructions from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, desired dot size and desired dot positions can be achieved.

The print controller 80 is provided with the image buffer memory 82; and image data, parameters, and other data are temporarily stored in the image buffer memory 82 when image data is processed in the print controller 80. The mode shown in FIG. 4 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements 58 (not shown in FIG. 4, but shown in FIG. 7) of the print heads 50 of the respective colors on the basis of print data supplied by the print controller 80. The head driver 84 can be provided with a feedback control system for maintaining constant drive conditions for the print heads.

As shown in FIG. 1, the print determination unit 24 is a block including a line sensor (not shown), which reads in the image printed onto the recording paper 16, performs various signal processing operations, and the like, and determines the print situation (presence/absence of ejection, variation in droplet ejection, and the like). The print determination unit 24 supplies these determination results to the print control unit 80.

According to requirements, the print controller 80 makes various corrections with respect to the print head 50 on the basis of information obtained from the print determination unit 24.

Structure of Print Head

Figure 5:
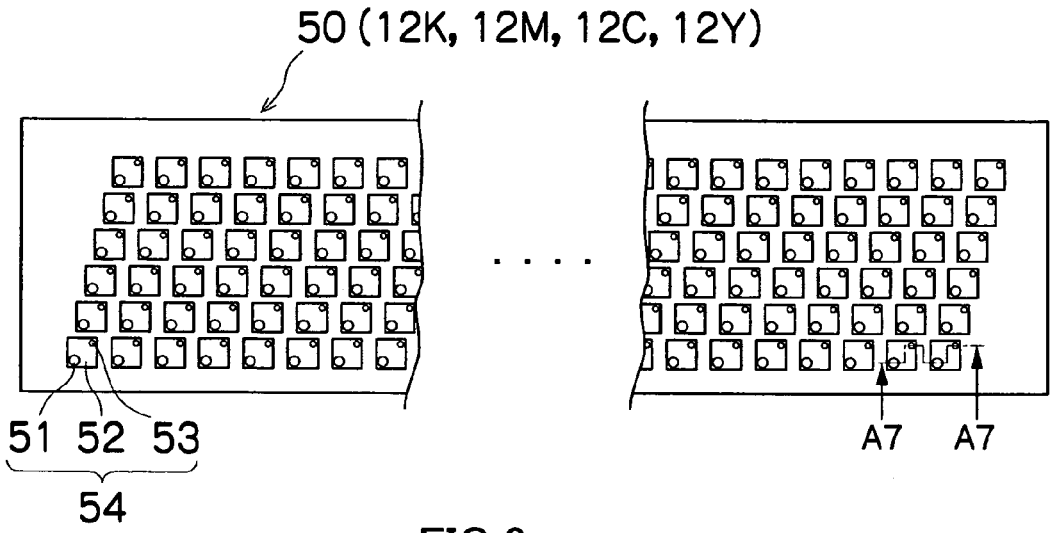
FIG. 5 is a perspective plan view showing a structural example of the print head.
Figure 6:
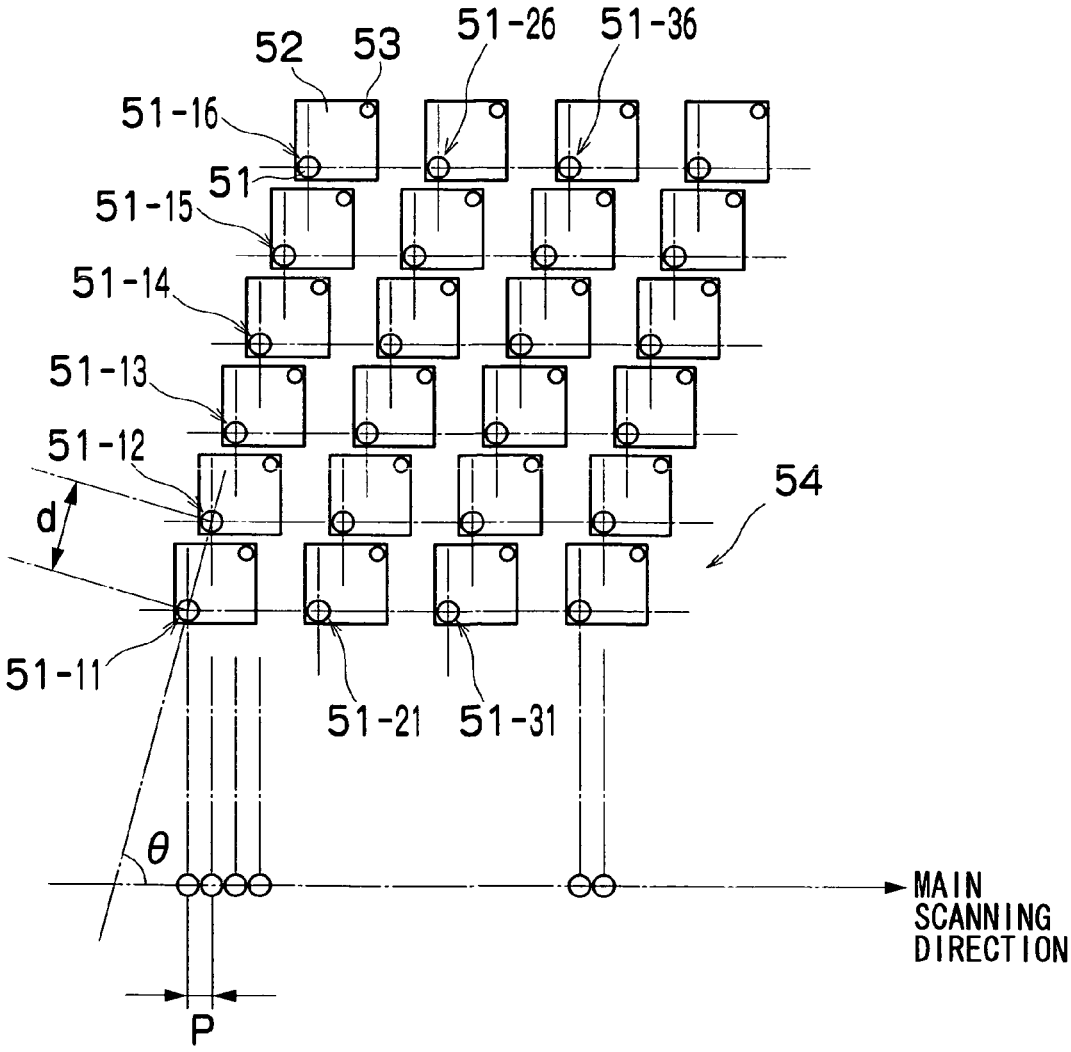
FIG. 6 is an enlarged view showing a nozzle array in the print head shown in FIG. 5.
Figure 7:
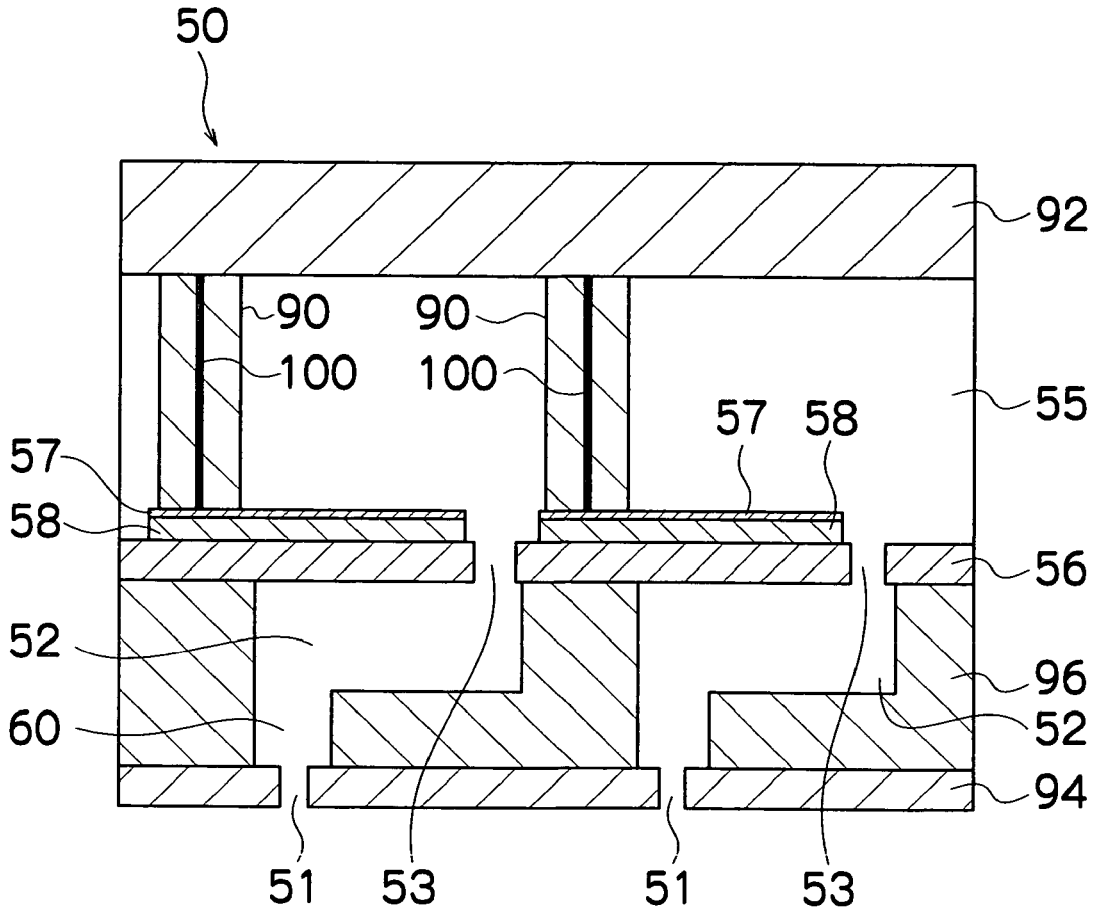
FIG. 7 is a sectional view along a line A7-A7 in FIG. 5.
Figure 8:
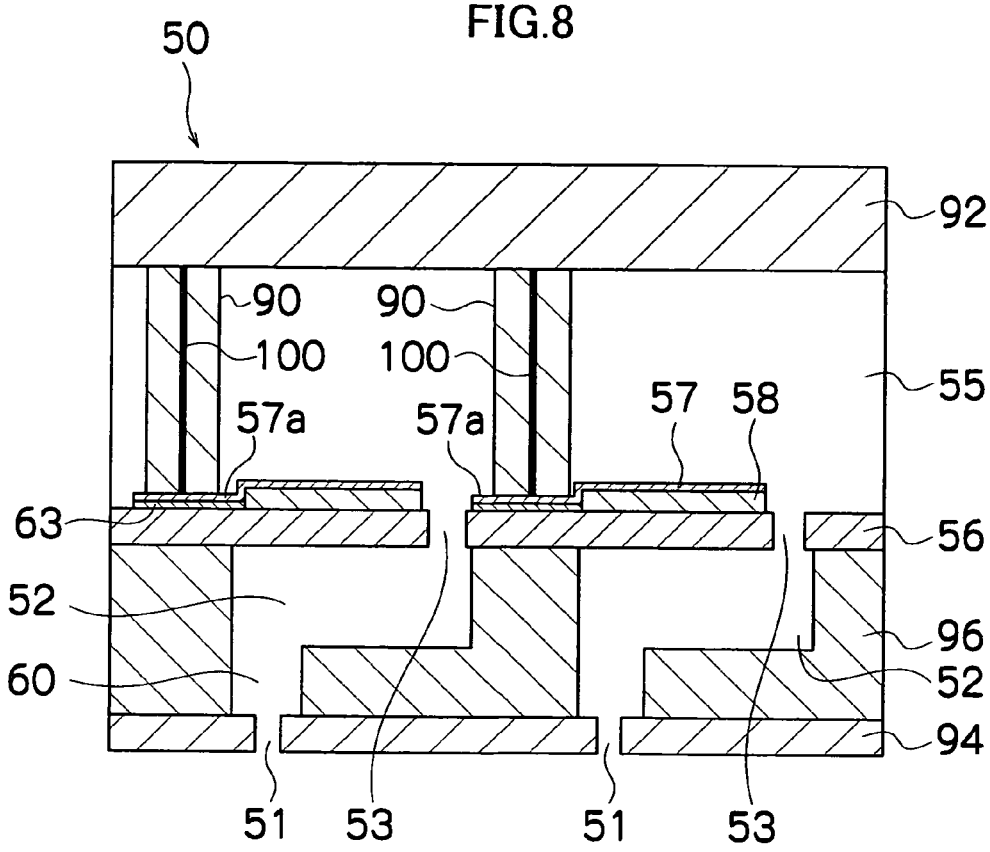
FIG. 8 is a sectional view showing another structural example of the print head.

Next, the structure of the print head 50 will be described below. FIG. 5 is a perspective plan view showing a structural example of the print head 50. FIG. 6 is an enlarged view showing a nozzle array in the print head 50 shown in FIG. 5. FIG. 7 is a sectional view along an A7-A7 line in FIG. 5. FIG. 8 is a sectional view showing another structural example of a print head.

To increase the density of the dot pitch at which printing is performed on the recording paper surface, the nozzle pitch in the print head 50 must be increased in density. As shown in FIG. 5, the print head 50 in this embodiment is constituted such that a plurality of ink chamber units 54, each comprising the nozzles 51 that eject the ink droplets, the pressure chamber 52 corresponding to the nozzle 51, and an ink supply port 53, are disposed in a staggered matrix form. In this way, a high density nozzle pitch is achieved.

The pressure chamber 52 provided for each nozzle 51 has a substantially square-shaped planar form with the nozzle 51 and ink supply port 53, which are provided at opposing corner portions on the diagonal.

As shown in FIG. 6, the large number of pressure chamber units 54 having this structure are arranged in a constant, lattice-form array pattern along a row direction in the main scanning direction and a column direction that is not orthogonal to the main scanning direction, but inclined at a constant angle θ. By arranging the plurality of ink chamber units 54 at a constant pitch d in the direction of the angle θ relative to the main scanning direction, a pitch P of the nozzles that are projected so as to line up in the main scanning direction is $d \times \cos\theta$.

In other words, concerning the main scanning direction, the nozzles shown in FIG. 6 may be considered substantially equivalent to the nozzles 51 that are arranged in a straight line at a constant pitch P. As a result of this constitution, it is possible to achieve a high nozzle density of 2,400 nozzles per inch when the nozzle arrays are projected so as to line up in the main scanning direction.

When the nozzles are driven in a full line head having nozzle arrays corresponding to the entire printable width, an operation such as (1) driving all of the nozzles simultaneously, (2) driving the nozzles in sequence from one nozzle to another, or (3) dividing the nozzles into blocks and driving the nozzles in block sequence from one block to another, is performed. Main scanning is defined as driving the nozzles to perform one of these operations such that one line or one strip-shape is printed in the width direction of the paper (the orthogonal direction to the paper conveyance direction).

In particular, when the nozzles 51 arranged in the matrix such as that shown in FIG. 6 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 depending on the conveyance velocity of the recording paper 16.

On the other hand, "sub-scanning" is defined as printing repeatedly one line (a line formed of a row of dots, or a line formed of a plurality of rows of dots) formed by the main scanning while the full-line head and the recording paper is moved relatively to each other.

Further, as shown in FIG. 7, a nozzle plate 94 (corresponding to a first member of the pressure chamber 52) in which the nozzle 51 is formed, a flow passage plate 96 in which the pressure chamber 52 is formed, and a diaphragm 56 (corresponding to a second member of the pressure chamber 52) in which the ink supply port 53 is formed are joined together in laminated form so that the pressure chamber 52 communicates with a common liquid chamber 55, which is disposed above the diaphragm 56 in FIG. 7, via the ink supply port 53.

Further, the piezoelectric element (piezoelectric actuator) 58 comprising an individual electrode 57 is joined to the top of the diaphragm 56 corresponding to the pressure chamber 52. The diaphragm 56 is constituted by a conductive material such as stainless steal, and serves as a common electrode in relation to the piezoelectric element 58.

An individual electrode wire 100 for the individual electrode 57 of the piezoelectric element 58 is provided inside a wiring member 90 that has a substantially columnar shape. The lower face of the wiring member 90 is joined to the individual electrode 57 by a conductive adhesive or the like so that electric conduction is achieved between the individual electrode 57 and individual electrode wire 100. As regards the common electrode (diaphragm) 56, a frame (not shown) of the print head 50 which contacts an end portion of the diaphragm 56 functions as a common electrode wire.

The upper face of the wiring member 90 is joined to a wiring substrate 92. The wiring substrate 92 is connected to the head driver 84 (see FIG. 4) such that drive signals transmitted from the head driver 84 are supplied to the individual electrode 57 through the wiring member 90.

The wiring member 90 stands upright in a direction substantially perpendicular to the diaphragm 56, and is constituted in a columnar form passing through the ink stored in the common liquid chamber 55. Therefore, the wiring member 90 is also called as an "electric column". The wiring member 90 is not limited to a columnar form, and may take a substantially rectangular column form or a substantially tapered form, for example.

An insulation/protection film (not shown) is formed on the parts that become wet with ink, the parts forming the wall surfaces of the common liquid chamber 55, such as the wiring member 90, the diaphragm 56, the piezoelectric element 58, and the wiring substrate 92.

In the print head 50 shown in FIG. 7, the common liquid chamber 55 is provided on the opposite side of the diaphragm 56 to the pressure chamber 52, and the wiring member 90 containing the individual electrode wire 100 that corresponds to the piezoelectric element 58 is provided so as to pass through the common liquid chamber 55. In this way, electric wiring space for the wiring substrate 92 or the like, which is connected to the head driver 84 (see FIG. 4) and so on, can be secured easily. Thus, it is possible to accommodate the increase in electric wiring that accompanies an increase in the density of the nozzles 51.

Further, by disposing the common liquid chamber 55 on the opposite of the diaphragm 56 to the pressure chamber 52, the common liquid chamber 55 can be formed in a larger size than that in the case where the common liquid chamber is disposed on the same side as the pressure chamber 52. Also, the length of a nozzle flow passage 60 between the pressure chamber 52 and nozzle 51 is shorter than that in the case where the common liquid chamber 55 is disposed on the same side as the pressure chamber 52. Moreover, the flow passage for transporting ink from the common liquid chamber 55 to the pressure chamber 52 can be formed straight, removing the need for complicated flow passages.

As a result, highly viscous (approximately 20 cp to 50 cp, for example) ink can be ejected. Further, the refilling operation performed after ink ejection can be performed quickly, and hence high frequency driving is possible.

The wiring member 90 is not limited to a constitution comprising a single individual electrode wire 100 corresponding to the piezoelectric element 58, and may comprise a plurality of the individual electrode wires 100. In this case, the number of wiring members 90 in the common liquid chamber 55 decreases, leading to a reduction in the flow resistance to the ink stored in the common liquid chamber 55 and hence to an improvement in the ink refilling performance.

Further, the wiling member 90 is not limited to a constitution that the wiring member 90 is disposed on the piezoelectric element 58 provided with the individual electrode 57. As shown in FIG. 8, for example, the wiring member 90 may be joined to an extending portion 57*a* of the individual electrode 57. In this case, an insulation layer 63 is provided between the extending portion 57*a* and diaphragm 56.

There are no particular limitations on the various dimensions of the print head 50 described above. For example, the pressure chamber 52 can have a square-shaped planar form of 300 μm×300 μm and a height of 150 μm, the diaphragm 56 and piezoelectric element 58 each can have a thickness of 10 μm, the diameter of the wiring member 90 at the joint portion with the individual electrode 57 can be 100 μm, the height of the wiring member 90 can be 500 μm, and so on.

Next, an operation of the print head 50 constituted in the manner described above will be described using FIG. 7.

The ink stored in the common liquid chamber 55 is supplied to the pressure chamber 52 through the ink supply port 53. When the head driver 84 (see FIG. 4) transmits a drive signal to the piezoelectric element 58, the drive signal is supplied to the individual electrode 57 through the wiring substrate 92 and wiring member 90. As a result, the piezoelectric element 58 is deformed, thereby deforming the diaphragm 56 that constitutes the ceiling face of the pressure chamber 52. The volume of the pressure chamber 52 decreases, causing the ink charged into the pressure chamber 52 to be ejected from the nozzle 51 as an ink droplet via the nozzle flow passage 60. Once the ink droplet has been ejected, new ink is supplied to the pressure chamber 52 from the common liquid chamber 55 through the ink supply port 53.

Disposal of Wiring Member

Next, disposal of the wiring member 90 will be described below.

Figure 9:
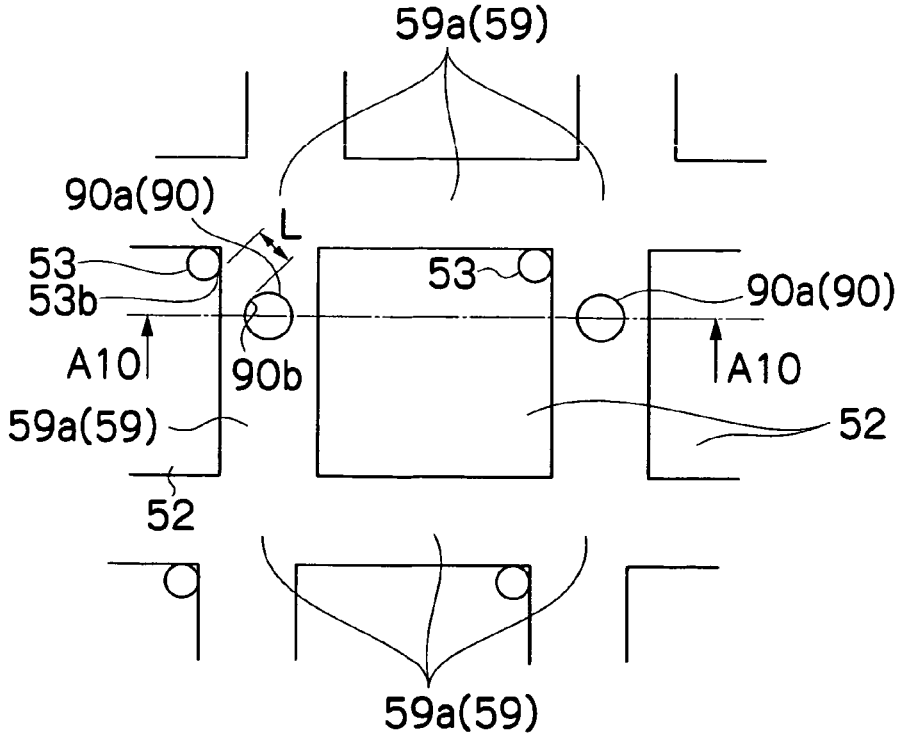
FIG. 9 is an illustrative view showing an example of the disposal of a wiring member, and a perspective plan view of the print head that is partially enlarged.
Figure 10:
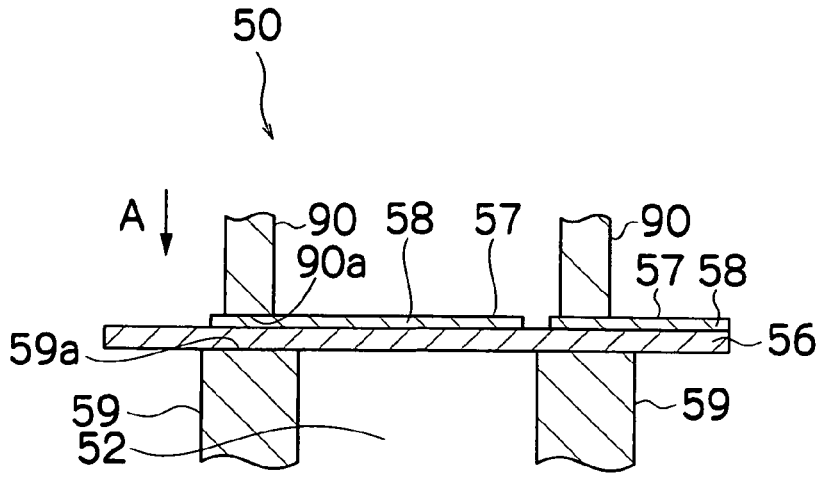
FIG. 10 is a principal sectional view along a line A10-A10 in FIG. 9.

FIG. 9 is an illustrative view showing a disposal example of the wiring member 90, and a perspective plan view of the print head 50 that is partially enlarged. FIG. 10 is a principal sectional view along a line A10-A10 in FIG. 9. The piezoelectric element 58 and individual electrode 57 have been omitted from FIG. 9 in order to illustrate clearly the disposal relationship between the wiring member 90 and a pressure chamber partition wall 59.

As shown in FIGS. 9 and 10, the wiring member 90 according to this embodiment is disposed in a position corresponding to the partition wall 59 (pressure chamber partition wall) formed between pressure chambers 52. More specifically, as shown in FIG. 9, when the print head 50 is viewed from above, a contact surface 90*a* (to be referred to as "wiring member contact surface" hereinafter) of the wiring member 90 which contacts (the individual electrode 57 of) the piezoelectric element 58 is disposed within a contact surface 59*a* (to be referred to as "pressure chamber partition wall contact surface" hereinafter) of the pressure chamber partition wall 59 which contacts the diaphragm 56. The wiring member contact surface 90*a* corresponds to the surface of the second member (diaphragm 56) of the pressure chamber 52 on the wiring member 90 side, and the pressure chamber partition wall contact surface 59*a* corresponds to the surface of the second member (diaphragm 56) of the pressure chamber 52 on the pressure chamber partition wall 59 side.

As shown in FIG. 10, when the print head 50 is viewed from the side, the wiring member 90 is disposed directly above (in the upper section of FIG. 10) the pressure chamber partition wall 59, and thus the wiring member 90 and the pressure chamber partition wall 59 are located across the diaphragm 56 and piezoelectric element 58. Hence, the wiring member 90 is supported by the pressure chamber partition wall 59 via the diaphragm 56 and piezoelectric element 58.

The wiring member 90 is joined to (the individual electrode 57 of) the piezoelectric element 58 by an adhesive or the like. When the wiring member 90 is joined in this manner, a load is applied to the wiring member 90 in the direction of an arrow A in FIG. 10. Accordingly, stress is applied to the piezoelectric element 58 and diaphragm 56 positioned directly below (in the lower section of FIG. 10) the wiring member 90 in the direction of the arrow A in FIG. 10. However, since the wiring member 90 is supported by the pressure chamber partition wall 59 via the piezoelectric element 58 and diaphragm 56 as described above, deformation of the piezoelectric element 58 and diaphragm 56 is prevented. As a result, the ejection performance is not affected by the joining, and the desired ejection performance can be obtained.

As shown in FIG. 9, an end portion 90*b* of the wiring member contact surface 90*a* and an opening portion end portion 53*b* of the ink supply port 53 are located separately from each other by a predetermined horizontal distance L. In this embodiment in particular, the horizontal distance L is preferably no less than 20 μm, and more preferably no less than 30 μm.

When the wiring member 90 is adhered to (the individual electrode 57 of) the piezoelectric element 58, excess adhesive may run out from the joint portion between the wiring member 90 and piezoelectric element 58. Hence, when the wiring member 90 is adhered in the vicinity of the ink supply port 53, the excess adhesive may flow into the ink supply port 53, causing a blockage in the ink supply port 53. Excess adhesive typically runs outward from the end portion of the joint surface by approximately 20 μm, and therefore by making the aforementioned horizontal distance L no less than 20 μm, blockage of the ink supply port 53 can be prevented. Furthermore, by making the horizontal distance L no less than 30 μm, blockage of the ink supply port 53 can be prevented even more reliably.

Furthermore, in this embodiment, the Young's modulus of the wiring member 90 is preferably set to be equal to or lower than the Young's modulus of the pressure chamber partition wall 59. When the pressure chamber partition wall 59 is constituted by stainless steal, for example, the wiring member 90 is preferably formed from stainless steal, or a metal or resin that is softer than stainless steal. Deformation of the pressure chamber partition wall 59 greatly affects the ejection performance of the print head 50, and therefore, by constituting the wiring member 90 to deform more easily than the pressure chamber partition wall 59, deformation of the pressure chamber partition wall 59 can be prevented so that the ejection performance is not affected thereby.

Figure 11:
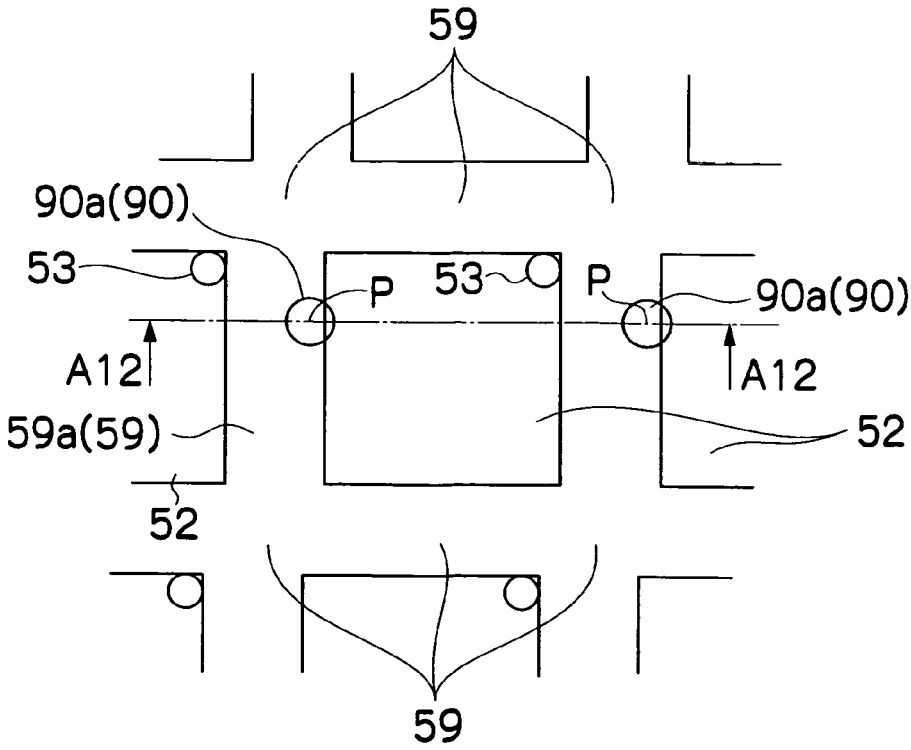
FIG. 11 is an illustrative view showing another example of the wiring member disposal shown in FIG. 9.
Figure 12:
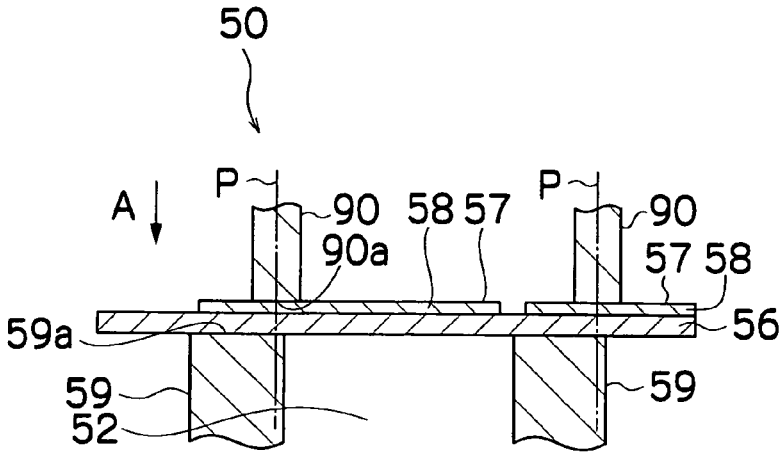
FIG. 12 is a sectional view along a line A12-A12 in FIG. 11.

FIG. 11 is an illustrative view showing another example of the disposal of the wiring member 90 shown in FIG. 9. FIG. 12 is a sectional view along a line A12-A12 in FIG. 11.

As shown in FIG. 11, when the print head 50 is viewed from above, a center P of the wiring member contact surface 90*a* is disposed within the pressure chamber partition wall contact surface 59*a*. Further, as shown in FIG. 12, when the print head 50 is seen from the side, the pressure chamber partition wall 59 is disposed on a line of extension from the center (central axis) P of the columnar wiring member 90.

With this constitution, as in the case of the disposal example of the wiring member 90 shown in FIGS. 9 and 10, deformation of the piezoelectric element 58 and diaphragm 56 positioned directly beneath the wiring member 90 is prevented.

The thickness of the pressure chamber partition wall 59 may not be constant, depending on the manufacturing method applied to the flow passage plate 96 (see FIG. 7) in which the pressure chamber 52 is formed. For example, when the pressure chamber 52 is formed by wet etching and the flow passage plate 96 is constituted by stainless steal, the pressure chamber partition wall 59 comprises a thick part and a thin part. In the following, disposal examples of the wiring member 90 when the thickness of the pressure chamber partition wall 59 is not constant will be described below.

Figure 13A:
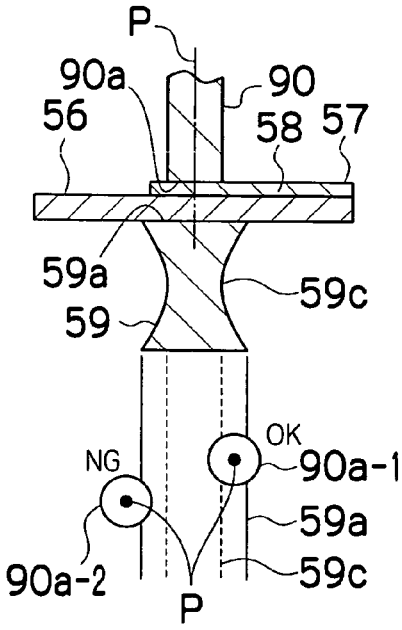
FIGS. 13A, 13B, and 13C show a first disposal example of the wiring member when the thickness of a pressure chamber partition wall is not constant.
Figure 13B:
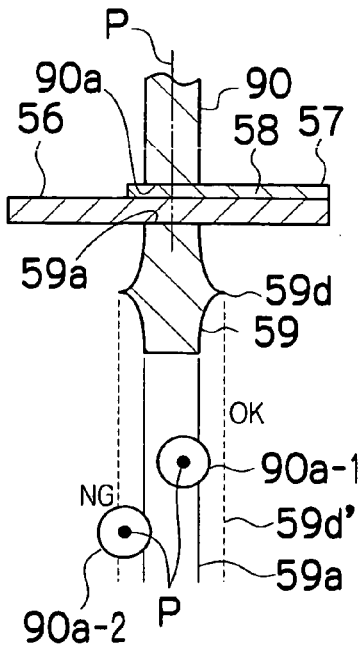
Figure 13C:
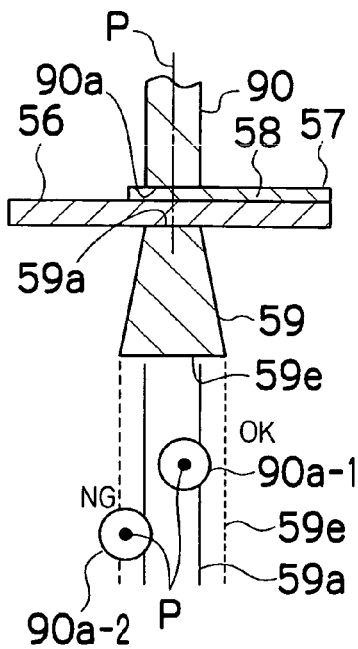

FIGS. 13A, 13B and 13C show a first disposal example of the wiring member 90 when the thickness of the pressure chamber partition wall 59 is not constant.

The pressure chamber partition wall 59 shown in the upper section of FIG. 13A takes a substantially recessed form that the substantially central portions in the vertical direction of the pressure chamber partition wall 59 is recessed inward. The lower section of FIG. 13A is a plan view of the pressure chamber partition wall 59, in which the area defined by solid lines indicates the pressure chamber partition wall contact surface 59*a*, and the area defined by broken lines indicates a thinnest portion 59*c* of the pressure chamber partition wall 59.

In the first disposal example, the wiring member 90 is disposed such that the center P of the wiring member contact surface 90*a* is overlapped with the pressure chamber partition wall contact surface 59*a*. In other words, as shown in the lower section of FIG. 13A, the wiring member 90 in the first disposal example is constituted with a wiring member contact surface 90*a*-1, the central portion P of which is overlapped with the pressure chamber partition wall contact surface 59*a*, rather than a wiring member contact surface 90*a*-2, the central portion P of which is not overlapped with the pressure chamber partition wall contact surface 59*a*.

The pressure chamber partition wall 59 shown in the upper section of FIG. 13B is formed with a protruding portion 59*d* in the substantially central portion in the vertical direction of the pressure chamber partition wall 59. In the plan view of the pressure chamber partition wall 59, shown in the lower section of FIG. 13B, the area defined by solid lines indicates the pressure chamber partition wall contact surface 59*a*, and the area defined by broken lines indicates a projected surface 59*d*' of the protruding portion 59*d*, the projected surface 59*d*' being projected onto the diaphragm 56. As shown in the lower section of FIG. 13B, when the pressure chamber partition wall 59 is formed in such a shape, the wiring member 90 is constituted with the wiring member contact surface 90*a*-1, the central portion P of which is overlapped with the pressure chamber partition wall contact surface 59*a*, rather than the wiring member contact surface 90*a*-2, the central portion P of which is not overlapped with the pressure chamber partition wall contact surface 59*a*.

The pressure chamber partition wall 59 shown in the upper section of FIG. 13C is formed in tapered form so as to widen gradually from the diaphragm 56 side toward the opposite direction to the side of the wiring member 90. In the plan view of the pressure chamber partition wall 59, shown in the lower section of FIG. 13C, the area defined by solid lines indicates the pressure chamber partition wall contact surface 59*a*, and the area defined by broken lines indicates an opposing surface 59*e* to the pressure chamber partition wall contact surface 59*a*. As shown in the lower section of FIG. 13C, when the pressure chamber partition wall 59 is formed in such a shape, the wiring member 90 is constituted with the wiring member contact surface 90*a*-1, the central portion P of which is overlapped with the pressure chamber partition wall contact surface 59*a*, rather than the wiring member contact surface 90*a*-2, the central portion P of which is not overlapped with the pressure chamber partition wall contact surface 59*a*.

By disposing the wiring member 90 so that the center P of the wiring member contact surface 90*a* is overlapped with the pressure chamber partition wall contact surface 59*a*, the piezoelectric element 58 and diaphragm 56 positioned directly below the center P of the wiring member 90 are supported by the pressure chamber partition wall contact surface 59*a*, and hence the diaphragm 56 can be prevented from deforming. As a result, deformation or breakage of the piezoelectric element 58 on the diaphragm 56 is prevented, making it possible to obtain the desired ejection performance.

Figure 14A:
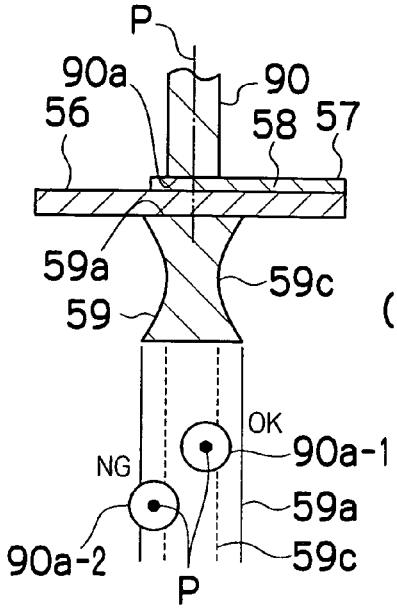
FIGS. 14A, 14B, and 14C show a second disposal example of the wiring member when the thickness of the pressure chamber partition wall is not constant.
Figure 14B:
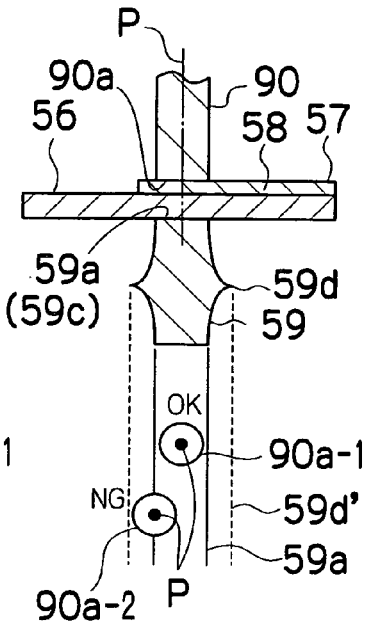
Figure 14C:
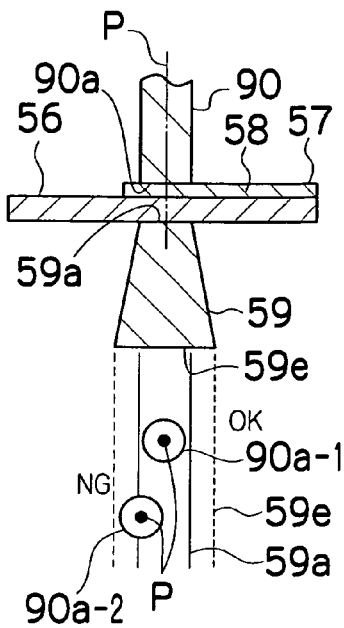

FIGS. 14A, 14B and 14C show a second disposal example of the wiring member 90 when the thickness of the pressure chamber partition wall 59 is not constant. The structures of the pressure chamber partition walls 59 shown in FIGS. 14A, 14B and 14C are identical to the structures of the pressure chamber partition walls 59 shown in FIGS. 13A, 13B and 13C, respectively.

The second disposal example is similar to the first disposal example in that the pressure chamber partition wall contact surface 59*a* is used as a reference, but differs in that the wiring member 90 is provided such that the wiring member contact surface 90*a* is entirely overlapped with the pressure chamber partition wall contact surface 59*a*.

In other words, the respective wiring members 90 in the second disposal example are constituted with the wiring member contact surface 90*a*-1, which is entirely overlapped with the pressure chamber partition wall contact surface 59*a*, rather than the wiring member contact surface 90*a*-2, the end portion of which gets out of the pressure chamber partition wall contact surface 59*a* as shown in FIGS. 14A, 14B and 14C.

By disposing the wiring member 90 so that the wiring member contact surface 90*a* is entirely overlapped with the pressure chamber partition wall contact surface 59*a*, the piezoelectric element 58 and diaphragm 56 positioned directly below the wiring member 90 are supported by the entire pressure chamber partition wall contact surface 59*a*. Hence, deformation of the diaphragm 56 can be prevented even more reliably than in the first disposal example.

Figure 15A:
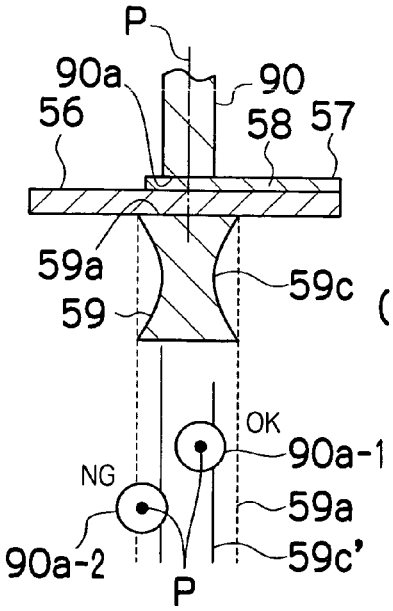
FIGS. 15A, 15B, and 15C show a third disposal example of the wiring member when the thickness of the pressure chamber partition wall is not constant.
Figure 15B:
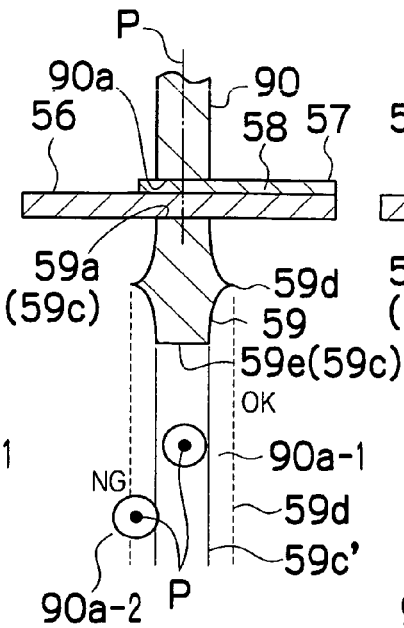
Figure 15C:
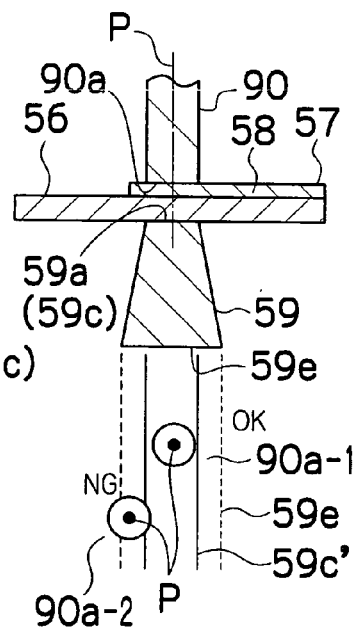

FIGS. 15A, 15B and 15C show a third disposal example of the wiring member 90 when the thickness of the pressure chamber partition wall 59 is not constant. The structures of the pressure chamber partition walls 59 shown in FIGS. 15A, 15B and 15C are identical to the structures of the pressure chamber partition walls 59 shown in FIGS. 13A, 13B and 13C, respectively.

In the first and second disposal examples, the pressure chamber partition wall contact surface 59*a* is used as a reference, but in the third disposal example, a projected surface of the thinnest portion of the pressure chamber partition wall 59, that is obtained by projecting the thinnest portion onto the diaphragm 56, is used as a reference, and the wiring member 90 is disposed so that the center P of the wiring member 90 is overlapped with this projected surface.

As shown in the upper section of FIG. 15A, in the pressure chamber partition wall 59 having the recessed form, the substantially central portion in the vertical direction forms the thinnest portion 59*c* (pressure chamber partition wall thinnest portion). In the lower section of FIG. 15A, the area defined by solid lines indicates a projected surface 59*c*' of the pressure chamber partition wall thinnest portion 59*c*, that is obtained by projecting the thinnest portion 59*c* onto the diaphragm 56. The wiring member 90 in the third disposal example is constituted with the wiring member contact surface 90*a*-1, the central portion P of which is overlapped with the projected surface 59*c*', rather than the wiring member contact surface 90*a*-2, the central portion P of which is not overlapped with the projected surface 59*c*'.

As shown in the upper section of FIG. 15B, in the pressure chamber partition wall 59 in which the substantially central portion in the vertical direction of the pressure chamber partition wall 59 forms the protruding portion 59*d*, the pressure chamber partition wall contact surface 59*a* and the opposing surface 59*e* form the pressure chamber partition wall thinnest portion 59*c*. In the lower section of FIG. 15B, the area defined by solid lines indicates the projected surface 59*c*' of the pressure chamber partition wall thinnest portion 59*c*, that is obtained by projecting the thinnest portion 59*c* onto the diaphragm 56. As in the case of FIG. 15A, the wiring member 90 in the third disposal example is constituted with the wiring member contact surface 90*a*-1, the central portion P of which is overlapped with the projected surface 59*c*', rather than the wiring member contact surface 90*a*-2, the central portion P of which is not overlapped with the projected surface 59*c*'.

As shown in the upper section of FIG. 15C, in the pressure chamber partition wall 59 having the tapered form which widens gradually from the diaphragm 56 side toward the opposite to the side of the wiring member 90, the pressure chamber partition wall contact surface 59*a* forms the pressure chamber partition wall thinnest portion 59*c*. In the lower section of FIG. 15C, the area defined by solid lines indicates the projected surface 59*c*' of the pressure chamber partition wall thinnest portion 59*c*, that is obtained by projecting the thinnest portion 59*c* onto the diaphragm 56. As in the cases of FIGS. 15A and 15B, the wiring member 90 in the third disposal example is constituted with the wiring member contact surface 90*a*-1, the central portion P of which is overlapped with the projected surface 59*c*', rather than the wiring member contact surface 90*a*-2, the central portion P of which is not overlapped with the projected surface 59*c*'.

Hence, by using the pressure chamber partition wall thinnest portion 59*c* as a reference rather than the pressure chamber partition wall contact surface 59*a*, deformation of the diaphragm 56 can be prevented more reliably than in the first disposal example, even when there are comparatively large variations among the thicknesses of the pressure chamber partition wall 59.

Figure 16A:
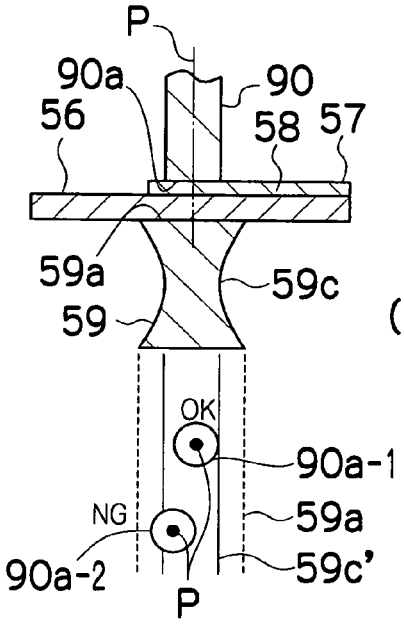
FIGS. 16A, 16B, and 16C show a fourth disposal example of the wiring member when the thickness of the pressure chamber partition wall is not constant.
Figure 16B:
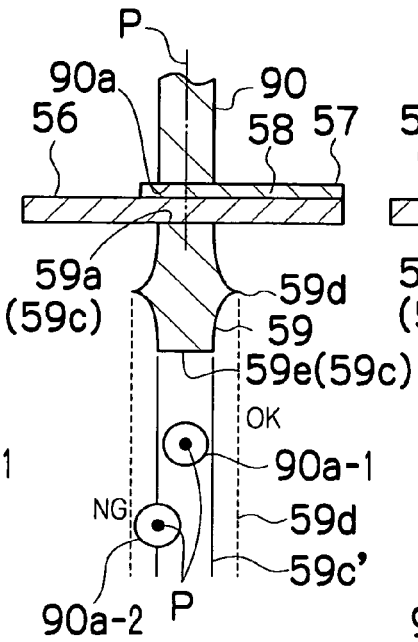
Figure 16C:
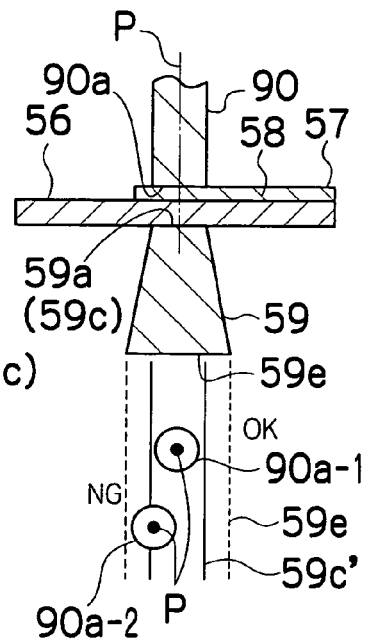

FIGS. 16A, 16B and 16C show a fourth disposal example of the wiring member 90 when the thickness of the pressure chamber partition wall 59 is not constant. The structures of the pressure chamber partition walls 59 shown in FIGS. 16A, 16B and 16C are identical to the structures of the pressure chamber partition walls 59 shown in FIGS. 13A, 13B and 13C, respectively.

The fourth disposal example is similar to the third disposal example in that a projected surface of the thinnest portion of the pressure chamber partition wall 59 projected onto the diaphragm 56 is used as a reference, but differs from the third disposal example in that the entire wiring member contact surface 90*a*, rather than only the center P of the wiring member 90, is overlapped with the projected surface. In other words, in each of the cases shown in FIGS. 16A, 16B and 16C, the wiring member 90 in the fourth disposal example is constituted with the wiring member contact surface 90*a*-1, which is entirely overlapped with the projected surface 59*c*' of the pressure chamber partition wall thinnest portion 59*c* projected onto the diaphragm 56, rather than the wiring member contact surface 90*a*-2, the end portion of which protrudes from the projected surface 59*c*' of the pressure chamber partition wall thinnest portion 59*c* projected onto the diaphragm 56.

In the fourth disposal example, the pressure chamber partition wall thinnest portion 59*c*, rather than the pressure chamber partition wall contact surface 59*a*, is used as a reference, and the entirety of the wiring member contact surface

90*a*, rather than merely the center P thereof, is overlapped with the projected surface 59*c*'. Hence, of the first through fourth disposal examples, the fourth disposal example can prevent the deformation of the diaphragm 56 most reliably.

Although the wiring member 90 that has a substantially columnar form has been described above, the wiring member 90 is not limited to this form, and may take a wall form, for example, as described below.

Figure 17:
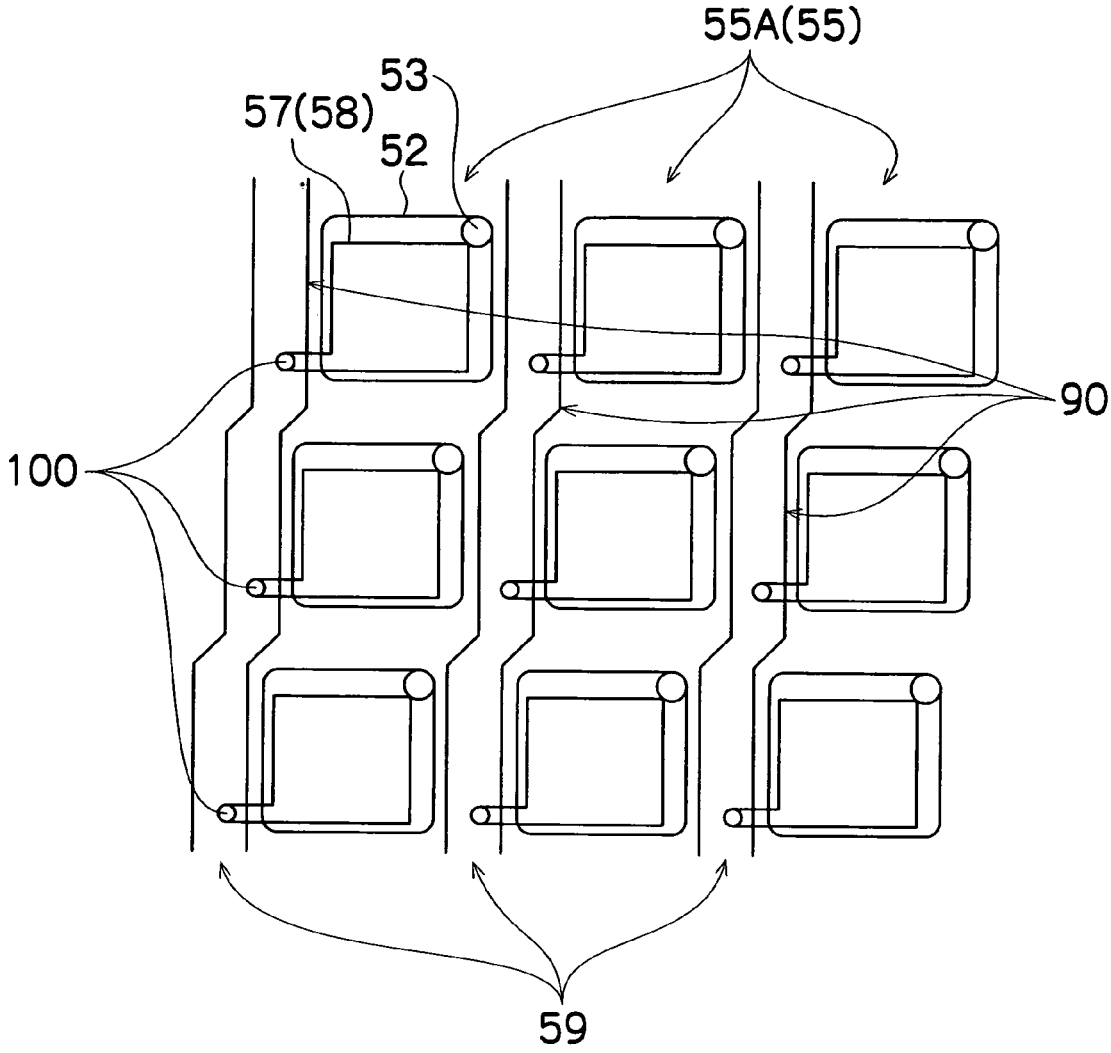
FIG. 17 is an illustrative view showing a constitutional example of a wall-form wiring member.
Figure 18:
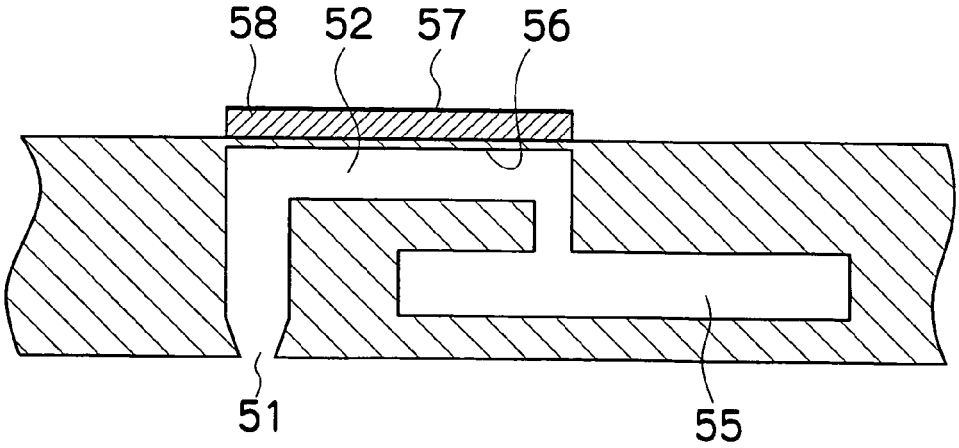
FIG. 18 is a sectional view showing the structure of a print head according to a related art.

FIG. 17 is an illustrative view showing a constitutional example of the wall-form wiring member 90, and a perspective plan view of the print head 50 that is partially enlarged. In FIG. 17, parts in common with those in FIG. 9 are denoted with identical reference numerals.

The wiring member 90 of FIG. 17 is formed in wall form, and disposed in a position corresponding to the pressure chamber partition wall 59. By means of the wall-form wiring member 90, the common liquid chamber 55 is divided into a plurality of tributaries 55A. The wiring member 90 comprises a plurality of the individual electrode wires 100, and each individual electrode wire 100 is connected electrically to the individual electrode 57 of the corresponding piezoelectric element 58, which has a substantially identical planar form to the pressure chamber 52.

FIG. 17 shows a most preferred aspect, in which the entire wall-form wiring member 90 is disposed in a position corresponding to the pressure chamber partition wall 59, but an embodiment according to the present invention is not limited to this mode. The wiring member 90 may be formed such that the center in the direction of thickness (the horizontal direction in FIG. 17) of the wiring member 90 is disposed in a position corresponding to the pressure chamber partition wall 59.

The liquid droplet ejection head and image forming apparatus in the embodiments according to the present invention are described above in detail, but the present invention is not limited to the above embodiments, and may be subjected to various improvements and modifications within a scope that does not depart from the spirit of the present invention.

What is claimed is:

1. A liquid droplet ejection head, comprising: a plurality of pressure chambers which are separated by a partition wall, each of the plurality of pressure chambers being formed with a first member and a second member in opposition to the first member, each of the plurality of pressure chambers having a nozzle and a supply port, the nozzle being formed in the first member for ejecting a droplet of a liquid onto a recording medium, the supply port being formed in the second member for supplying the liquid to the pressure chamber; a piezoelectric element which causes the pressure chamber to deform, the piezoelectric element having an electrode for the piezoelectric element, the piezoelectric element being provided on a side of the second member opposite to an inside of the pressure chamber; a common liquid chamber which supplies the liquid to the pressure chamber through the supply port, the common liquid chamber being provided on the side of the second member on which the piezoelectric element is provided; a wiring substrate being provided on a side of the common liquid chamber opposite to the side of the second member; and a wiring member which is formed in the common liquid chamber so as to stand upright from the electrode for the piezoelectric element in a direction substantially perpendicular to the second member, and is disposed in a position corresponding to the partition wall, wherein the wiring member includes an electrode wire which is provided inside the wiring member and connects the wiring substrate to the electrode for the piezoelectric element.

2. The liquid droplet ejection head as defined in claim 1, wherein the wiring member is disposed so that a center of a surface of the wiring member on the side of the second member is overlapped with a surface of the partition wall contacting the second member.

3. The liquid droplet ejection head as defined in claim 1, wherein a Young's modulus of the wiring member is equal to or lower than a Young's modulus of the partition wall.

4. The liquid droplet ejection head as defined in claim 1, wherein the wiring member is disposed away from the supply port by a predetermined distance.

5. The liquid droplet ejection head as defined in claim 4, wherein the predetermined distance is no less than 20 μm.

6. The liquid droplet ejection head as defined in claim 4, wherein the predetermined distance is no less than 30 μm.

7. An image forming apparatus comprising the liquid droplet ejection head as defined in claim 1.

8. The liquid droplet ejection head as defined in claim 1, wherein the wiring member has a column shape.

* * * * *